US008754319B2

(12) United States Patent
Yamada

(10) Patent No.: US 8,754,319 B2
(45) Date of Patent: Jun. 17, 2014

(54) ELECTRONIC PERCUSSION INSTRUMENT SET AND MUSICAL PERFORMANCE EVALUATING APPARATUS

(71) Applicant: Yamaha Corporation, Hamamatsu (JP)

(72) Inventor: Yuji Yamada, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 13/850,391

(22) Filed: Mar. 26, 2013

(65) Prior Publication Data

US 2013/0247747 A1 Sep. 26, 2013

(30) Foreign Application Priority Data

Mar. 26, 2012 (JP) ..... 2012-68891
Mar. 12, 2013 (JP) ..... 2013-48664

(51) Int. Cl.
*G10H 1/32* (2006.01)
*G10H 3/00* (2006.01)
*G10H 3/14* (2006.01)

(52) U.S. Cl.
CPC ..... *G10H 3/146* (2013.01); *G10H 2230/281* (2013.01); *G10H 2210/091* (2013.01)
USPC ..... 84/743; 84/600; 84/477 R; 463/7

(58) Field of Classification Search
USPC ..... 84/743, 600, 477 R; 434/307 A; 463/35, 463/48; 278/440
See application file for complete search history.

(56) References Cited

U.S. PATENT DOCUMENTS 6,545,207 B2 4/2003 McAfee et al.

*Primary Examiner* — Jeffrey Donels
(74) *Attorney, Agent, or Firm* — Rossi, Kimms & McDowell LLP

(57) ABSTRACT

A plurality of pads SN to CY2 each of which is assigned a tone color of a different musical instrument, and has a surface which a player strikes are provided. Furthermore, a controller CT having a CPU 18*a* for identifying a pad included in the pads SN to CY2 and struck by the player is also provided. The controller CT has a tone generator 16 for generating musical tones of a musical instrument assigned to the identified pad. The CPU 18*a* evaluates the player's performance and scores the performance. More specifically, the CPU 18*a* awards an amount of points when the first and the second pads which are included in the pads SN to CY2 but are different with each other are struck in a sequence. Furthermore, a display unit 15 for displaying the awarded score is also provided.

12 Claims, 9 Drawing Sheets

FIG.7

| struck pad / active pad count value | (initialization) | SN | → | TM1 | → | TM2 | → | TM3 | → | BS | → | HH | → |
|---|---|---|---|---|---|---|---|---|---|---|---|---|---|
| SNC | 5 | → | 0 | → | 1 | → | 2 | → | 3 | → | 4 | → | 5 |
| TM1C | 5 | → | 5 | → | 0 | → | 1 | → | 2 | → | 3 | → | 4 |
| TM2C | 5 | → | 5 | → | 5 | → | 0 | → | 1 | → | 2 | → | 3 |
| TM3C | 5 | → | 5 | → | 5 | → | 5 | → | 0 | → | 1 | → | 2 |
| BSC | 5 | → | 5 | → | 5 | → | 5 | → | 5 | → | 0 | → | 1 |
| HHC | 5 | → | 5 | → | 5 | → | 5 | → | 5 | → | 5 | → | 0 |
| CY1C | 5 | → | 5 | → | 5 | → | 5 | → | 5 | → | 5 | → | 5 |
| CY2C | 5 | → | 5 | → | 5 | → | 5 | → | 5 | → | 5 | → | 5 |

FIG.8

| pad type | pad type coefficient |
|---|---|
| SN | 1 |
| TM1 | 1.3 |
| TM2 | 1.2 |
| TM3 | 1.1 |
| BSC | 1 |
| HH | 1.4 |
| CY1 | 1.5 |
| CY2 | 1.4 |

FIG.9

| previously struck pad | currently struck pad | move distance coefficient |
|---|---|---|
| SN | HH | 1 |
| SN | TM1 | 1 |
| SN | TM2 | 2 |
| SN | TM3 | 3 |
| SN | CY1 | 3 |
| SN | CY2 | 3 |
| TM1 | SN | 1 |
| TM1 | HH | 1 |
| TM1 | TM2 | 1 |
| TM1 | TM3 | 2 |
| TM1 | CY1 | 3 |
| TM1 | CY2 | 3 |
| TM2 | SN | 2 |
| TM2 | HH | 2 |
| TM2 | TM1 | 1 |
| TM2 | TM3 | 1 |
| TM2 | CY1 | 3 |
| TM2 | CY2 | 3 |
| TM3 | SN | 3 |
| TM3 | HH | 3 |
| TM3 | TM1 | 2 |
| TM3 | TM2 | 1 |
| TM3 | CY1 | 3 |
| TM3 | CY2 | 3 |
| HH | SN | 1 |
| HH | TM1 | 1 |
| HH | TM2 | 2 |
| HH | TM3 | 3 |
| HH | CY1 | 3 |
| HH | CY2 | 3 |
| CY1 | SN | 3 |
| CY1 | HH | 3 |
| CY1 | TM1 | 3 |
| CY1 | TM2 | 3 |
| CY1 | TM3 | 3 |
| CY1 | CY2 | 3 |
| CY2 | SN | 3 |
| CY2 | TM1 | 3 |
| CY2 | TM2 | 3 |
| CY2 | TM3 | 3 |
| CY2 | HH | 3 |
| CY2 | CY1 | 3 |

ELECTRONIC PERCUSSION INSTRUMENT SET AND MUSICAL PERFORMANCE EVALUATING APPARATUS

BACKGROUND OF THE INVENTION

1. Field of the Invention

The present invention relates to an electronic percussion instrument set such as electronic drums and electronic cymbals and relates to a musical performance evaluating apparatus which evaluates performance of an electronic percussion instrument set.

2. Description of the Related Art

Conventionally, there is an electronic percussion instrument which imitates an acoustic drum such as disclosed in U.S. Pat. No. 6,545,207. The electronic percussion instrument has a capability of counting the number of consecutive strikes on an electronic pad over a given period of time and evaluating the beating speed.

SUMMARY OF THE INVENTION

For drum players, not only the striking speed but also playing lively by successively striking different kinds of percussion instruments is an important technique necessary for a lively performance. However, conventional electronic percussion instrument sets are not provided with a capability of evaluating liveliness of a performance.

The present invention was accomplished to solve the above-described problem, and an object thereof is to provide an electronic percussion instrument set or a musical performance evaluating apparatus having a capability of evaluating liveliness of a performance. As for descriptions for respective constituents of the present invention described below, numbers corresponding to components of a later-described embodiment are given in parenthesis for easy understanding. However, the respective constituents of the present invention are not limited to the corresponding components indicated by the numbers of the embodiment.

In order to achieve the above-described object, it is a feature of the present invention to provide an electronic percussion instrument set including a plurality of strike portions (SN to CY2) each of which is assigned a tone color of a different musical instrument and is provided to be struck by a player; an identifying section (S42) for identifying the strike portion included in the plurality of the strike portion and struck by the player; a tone generating section (16, 17, S43) for generating a musical tone of the musical instrument assigned to the identified strike portion; a scoring section (S50) for awarding a score in accordance with a performance, and more specifically, for awarding an amount of points when a first strike portion and a second strike portion which are included in the plurality of strike portions but are different with each other are struck in a sequence; and a displaying section (15, S51) for displaying the awarded score.

Furthermore, it is another feature of the present invention to provide a musical performance evaluating apparatus including a receiving section for receiving, from an electronic percussion instrument set having a plurality of strike portions each of which is assigned a tone color of a different musical instrument and is provided to be struck by a player, information which identifies a strike portion included in the plurality of strike portions and struck by the player; a scoring section for awarding a score in accordance with a performance, and more specifically, for awarding an amount of points when a first strike portion and a second strike portion which are included in the plurality of strike portions but are different with each other are struck in a sequence; and a displaying section for displaying the awarded score.

In this case, the plurality of strike portions imitate shapes of percussion instruments, for example. Furthermore, the plurality of strike portions may be obtained by dividing a pad surface into a plurality of sections. Furthermore, the scoring section awards an amount of points in accordance with the striking sequence of the first strike portion and the second strike portion, for example.

The electronic percussion instrument set or the musical performance evaluating apparatus configured as above awards a score when different strike portions are struck in succession. More specifically, the scoring section awards an amount of points under the condition in which the first strike portion and the second strike portion which are included in the plurality of strike portions but are different with each other are struck in a sequence. Therefore, the electronic percussion instrument set is able to evaluate liveliness of performance.

It is still another feature of the present invention that the greater a distance between the first and second strike portions is, the higher the amount of points will be. As the distance between successively struck two pads increases, the body movement of a player will be more dynamically, resulting in a livelier performance. By this configuration, therefore, the player's body movements can be taken into consideration for evaluation of performance.

It is a further feature of the present invention that in a case where the first strike portion was struck before a strike on the second strike portion, the scoring section awards the amount of points only if a previous strike on the second strike portion had been followed by a predetermined number of strikes or more strikes on the strike portions which is not the second strike portion. In a case where only two of the pads are struck alternately by the player with right and left sticks, brushes or the like, the player's body movements will not be dynamic that much to fail to produce lively performance. Therefore, the electronic percussion instrument set is designed such that until a strike on one of the strike portions is followed by a predetermined number of strikes or more strikes on the other strike portions, the distance between the successively struck strike portions will not affect the score to allow the player's body movements to be appropriately taken into consideration in evaluating the performance.

It is still a further feature of the present invention that the scoring section further awards an amount of points corresponding to a time interval between the strikes on the first and second strike portions. As for performance of electronic percussion instruments, the faster the striking speed is, the livelier the performance will be. By this configuration, therefore, striking speed can be taken into consideration in evaluating player's performance.

It is another feature of the present invention that the electronic percussion instrument set further includes strike a strength detecting section for detecting a strength of the strike on the identified strike portion, wherein the scoring section further awards an amount of points corresponding to the strength of the strike. As for performance of electronic percussion instruments, the greater the striking strength is, the livelier the performance will be. By this configuration, therefore, striking strength can be taken into consideration in evaluating player's performance.

It is still another feature of the present invention that the scoring section further awards an amount of points corresponding to the shape of the identified strike portion. As for performance of electronic percussion instruments, the degree of difficulty in performance varies according to the shape of the strike portion (e.g., the shape of a snare drum, or the shape of a cymbal). By this configuration, therefore, the difficulty in performance depending on the strike portion can be taken into consideration in evaluating player's performance.

It is a further feature of the present invention that the scoring section further awards an amount of points in accordance with the number of strike portions struck within a predetermined period of time. As for performance of electronic percussion instruments, the faster the striking speed is, the livelier the performance will be. By this configuration, therefore, striking speed can be taken into consideration in evaluating player's performance.

Furthermore, the present invention can be embodied not only as the invention of the electronic percussion instrument set but also as an invention of a method and an invention of a computer program applied to an electronic percussion instrument set.

BRIEF DESCRIPTION OF THE DRAWINGS

FIG. 7 is an example chart of changing active pad count values;

FIG. 8 is an example chart of pad type coefficient; and

FIG. 9 is an example chart of move distance coefficient.

DESCRIPTION OF THE PREFERRED EMBODIMENT

Figure 1:
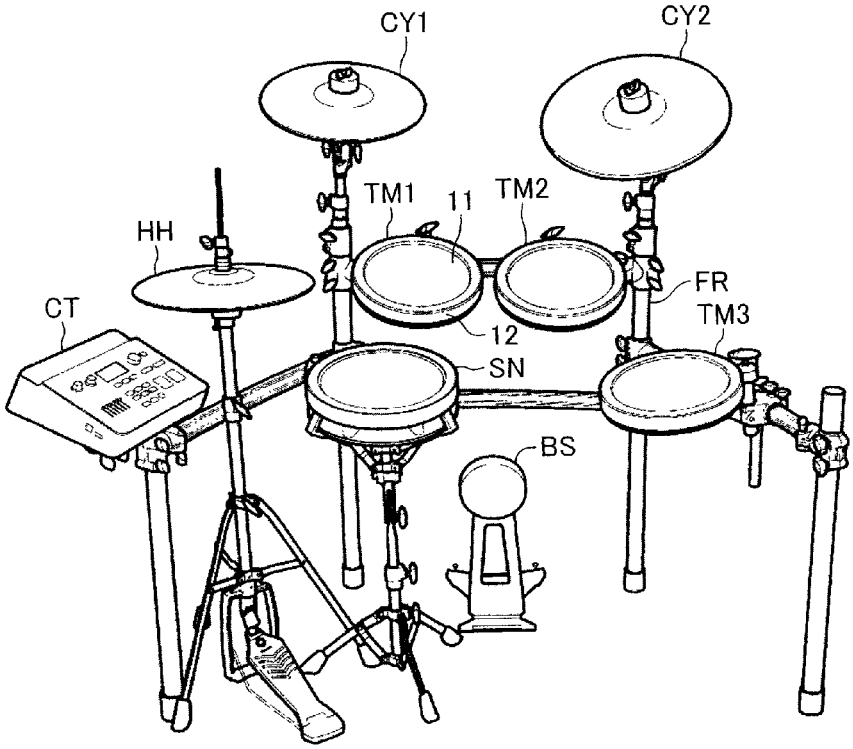
FIG. 1 is a diagram indicating a general outline of an entire electronic percussion instrument set according to an embodiment of the present invention.

A general outline of an electronic percussion instrument set according to an embodiment of the present invention will now be described with reference to the drawings. As indicated in FIG. 1, the electronic percussion instrument set is formed of a pad SN, a pad TM1, a pad TM2, a pad TM3, a pad BS, a pad HH, a pad CY1, a pad CY2, a frame FR and a controller CT. Hereafter, the above-described pads SN to CY2 are referred to as the pads. The pads imitate respective shapes of percussion instruments which form an acoustic drum set. More specifically, the pad SN, pad TM1, pad TM2, and pad TM3 imitate shapes of a snare drum, a first tom, a second tom and a third torn, respectively. The pad BS imitates the shape of a bass drum. The pad HH, pad CY1 and pad CY2 imitate shapes of a hi-hat, a first cymbal (e.g., crash cymbal) and a second cymbal (e.g., ride cymbal), respectively.

The pads except the pad SN, pad HH and pad BS are mounted to the frame FR assembled by connecting pipes. The pad SN, the pad HH and the pad BS are mounted on stands placed on a floor. The pads are hit with sticks, brushes or the like so that striking operation information indicative of player's striking operation will be supplied to the controller CT. However, the pad HH is mounted on a stand having a pedal. By player's operation of depressing the pedal mounted to the stand with the player's foot, the pad HH moves up and down. In response to the player's operation of the pad HH, pedal operation information corresponding to the amount of hi-hat openness is also supplied to the controller CT. In response to the player's strike on the pad BS with a beater of a pedal (not shown) provided on the floor on the player's side for a bass drum of an acoustic drum, striking operation information indicative of the player's striking operation is supplied to the controller CT.

Figure 2:
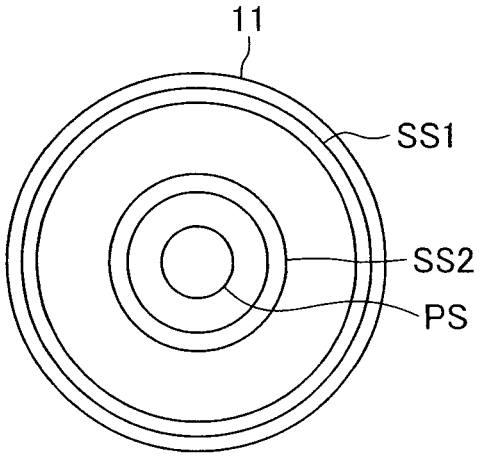
FIG. 2 is a diagram indicating a bottom of a strike portion of a pad.

Each of the pad SN, pad TM1, pad TM2, pad TM3 and Pad BS has a rubber head portion 11 which is hit with a stick, brush or the like (beater, in a case of the pad BS). The head portion 11 is shaped like a thin circular disk, and is provided so that the head portion 11 will fill an opening end of a shallow cylindrical case 12 whose bottom is closed. Furthermore, the outer periphery or the bottom surface of the case 12 is mounted to the frame FR or the stand. As indicated in FIG. 2, a piezo sensor PS for detecting strikes is provided on the underside of the head portion 11. The piezo sensor PS is shaped like a circular disk. The piezo sensor PS outputs a signal corresponding to the magnitude of impact of a strike against the head portion 11 as striking operation information. On the underside of the head portion 11, furthermore, a first sheet sensor SS1 and a second sheet sensor SS2 are provided along the circumference of the head portion 11. In this embodiment, each of the first sheet sensor SS1 and the second sheet sensor SS2 is shaped like a ring. The first sheet sensor SS1 is attached to the outer edge of the underside of the head portion 11, while the second sheet sensor SS2 is attached to be situated slightly away from the center of the underside of the head portion 11. Each of the first sheet sensor SS1 and the second sheet sensor SS2 is a switch shaped like a film. When the head portion 11 is struck, a struck portion of the head portion 11 is elastically deformed. In a case where the struck portion is near the outer edge of the head portion 11, more specifically, the first sheet sensor SS1 is also elastically deformed to momentarily change from an off-state to an on-state. In a case where the struck portion is near the center of the head portion 11, the second sheet sensor SS2 is elastically deformed to momentarily change from an off-state to an on-state. Each of the first sheet sensor SS1 and the second sheet sensor SS2 outputs the on/off state to the controller CT as striking operation information.

The pad HH, pad CY1 and pad CY2 are shaped differently from the pad SN, pad TM1, pad TM2, pad TM3 and pad BS in order to imitate the shapes of cymbals of an acoustic drum set, but have a head portion similar to the head portion 11 of the pad SN, pad TM1, pad TM2, pad TM3 and pad BS. Therefore, the explanation of the head portion of the pad HH, pad CY1 and pad CY2 will be omitted.

Figure 3:
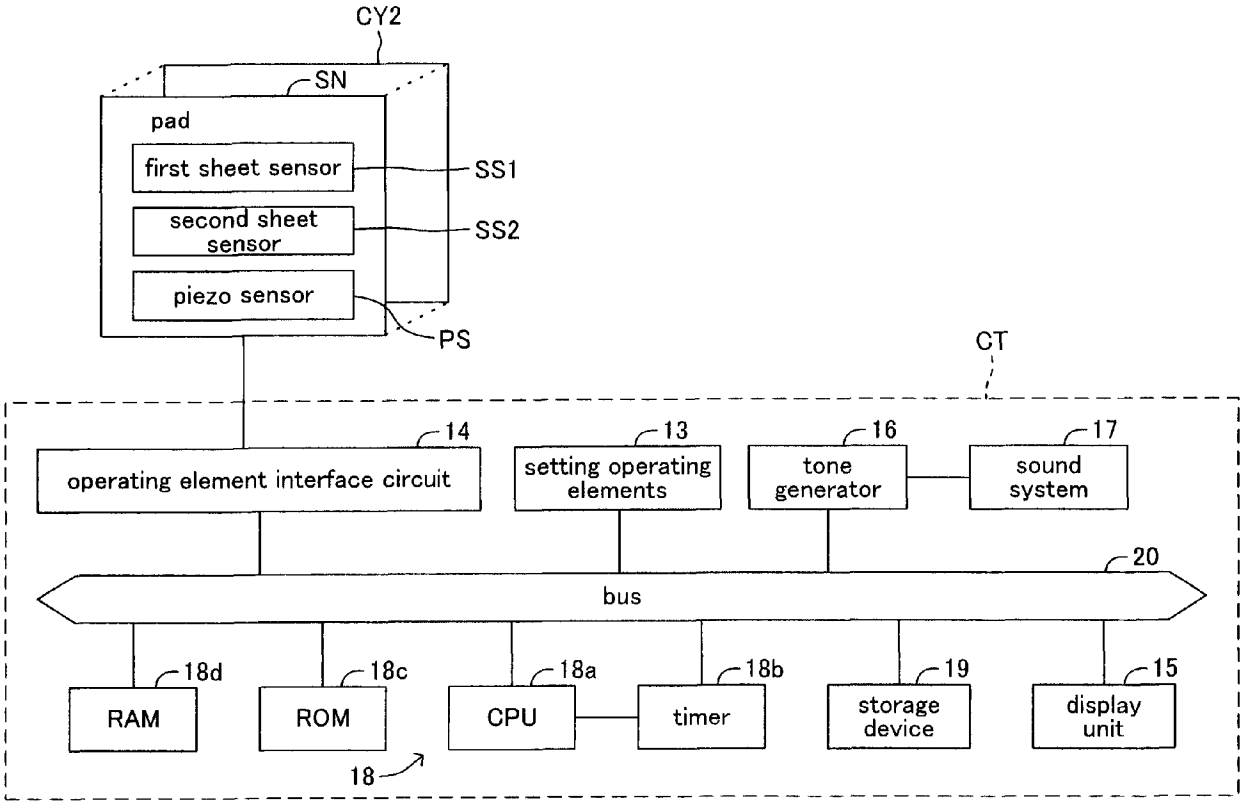
FIG. 3 is a block diagram indicating a configuration of a controller.

The controller CT has setting operating elements 13, an operating element interface circuit 14, a display unit 15, a tone generator 16, a sound system 17, a computer portion 18 and a storage device 19 as indicated in FIG. 3.

Each pad is connected to the operating element interface circuit 14 connected to a bus 20. Striking operation information output from each pad and pedal operation information output from the pad HH are supplied to the later-described computer portion 18 via the operating element interface circuit 14 and the bus 20.

The setting operating elements 13 are provided on an operating panel of the controller CT so that a player can operate the setting operating elements 13 with the player's hand to set various musical tone characteristics such as tone color, tone volume and effect of musical tone signals which are to be generated and to make settings on the entire operation of the electronic percussion instrument set. As described later, the electronic percussion instrument set has two operating modes: an evaluation mode in which player's performance is evaluated and a normal mode in which player's performance will not be evaluated. The setting operating elements 13 include a mode switch for switching the operating mode of the electronic percussion instrument set, a start/stop switch for starting/stopping evaluation of performance, and an evaluation setting switch for changing the settings on the evaluation mode. The setting operating elements 13 are connected to the bus 20 to supply operation information indicative of player's operation of the setting operating elements 13 to the computer portion 18.

The display unit 15 is configured by a liquid crystal display (LCD), a 7-segment LED or the like to display characters, graphics and the like. The display of the display unit 15 is controlled by the computer portion 18.

The tone generator 16 includes a waveform memory in which sets of waveform data are stored to read out waveform data designated by the computer portion 18 from the waveform memory to generate digital musical tone signals to supply the generated digital musical tone signals to the sound system 17. More specifically, the tone generator 16 generates digital musical tone signals indicative of struck tones corresponding to pads struck by the player, and supplies the generated signals to the sound system 17. The sound system 17 has a D/A converter for converting digital musical tone signals supplied from the tone generator 16 to analog musical tone signals, an amplifier for amplifying the converted analog musical tone signals, and speakers for converting the amplified analog musical tone signals to audio signals and outputting the audio signals.

The computer portion 18 is formed of a CPU 18*a*, a timer 18*b*, a ROM 18*c* and a RAM 18*d* which are connected to the bus 20. The CPU 18*a* supplies information necessary for generation of tones to the tone generator 16 in accordance with striking operation information and pedal operation information supplied from the operating element interface circuit 14. Furthermore, the CPU 18*a* detects strike strength KY indicative of the strength of a strike by use of a signal output from the piezo sensor PS. The CPU 18*a* also detects strike position IC indicative of a position struck on the pad by use of a signal output from the first sheet sensor SS1 and the second sheet sensor SS2. More specifically, when the first sheet sensor SS1 is turned on, the CPU 18*a* judges that the circumference portion of the head portion 11 was hit. When the second sheet sensor SS2 is turned on, the CPU 18*a* judges that the center portion of the head portion 11 was hit. As described in detail later, furthermore, the CPU 18*a* evaluates player's performance and displays a score on the display unit 15 in the evaluation mode.

The storage device 19 includes large-capacity nonvolatile storage media such as HDD, FDD, CD-ROM, MO and DVD, and drive units for the storage media, so that the storage device 19 can store and read out various kinds of data and programs. The data and programs may be previously stored in the storage device 19 or externally retrieved via an external interface circuit which is not shown. The various kinds of data and programs stored in the storage device 19 are read by the CPU 18*a* to use for control of the electronic percussion instrument set.

Figure 4:
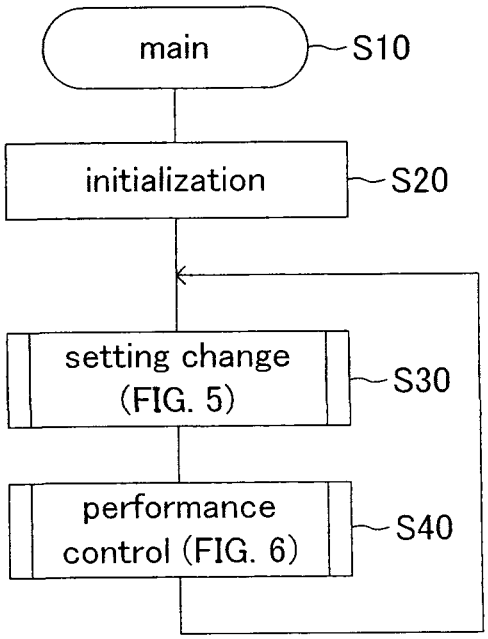
FIG. 4 is a flowchart of a main program.
Figure 5:
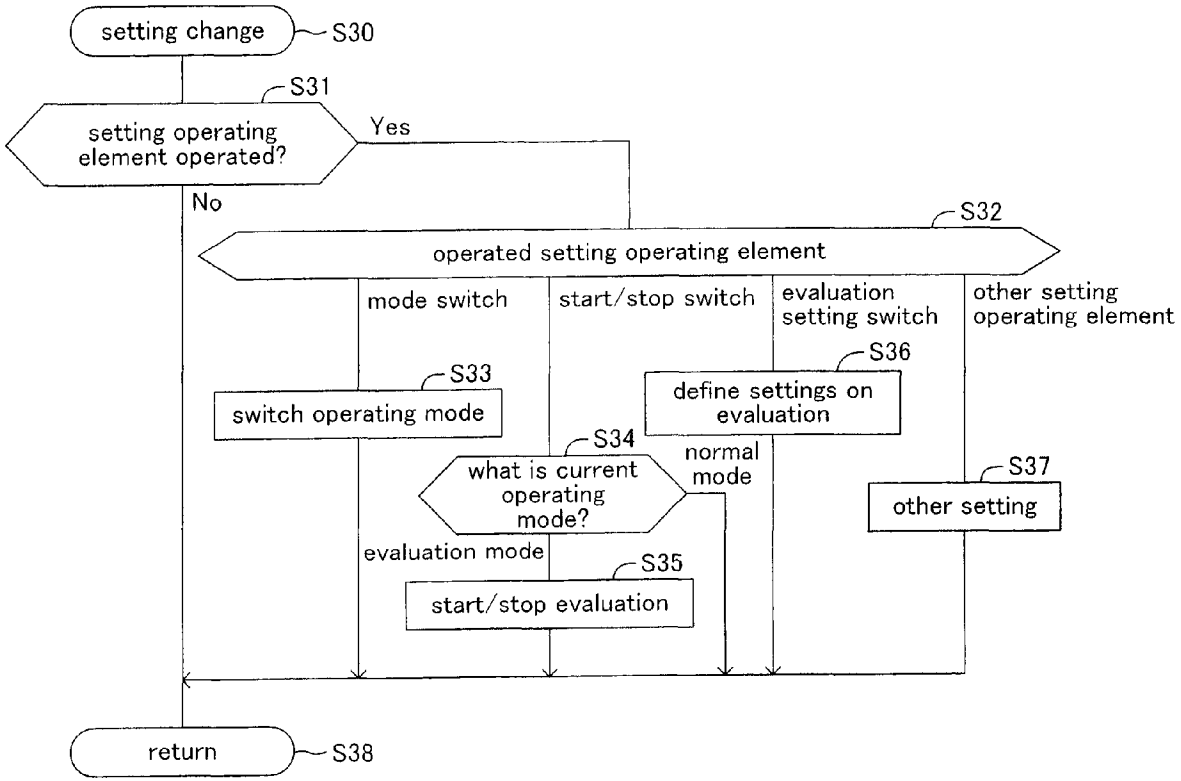
FIG. 5 is a flowchart of a setting change program.

Next, operation of the electronic percussion instrument set configured as described above will be explained. Particularly, the procedure of evaluating performance will be explained in detail. When the player turns on a power switch (not shown) of the electronic percussion instrument set, the CPU 18*a* carries out a main program indicated in FIG. 4. After starting the main process at step S10, the CPU 18*a* initializes various circuits of the controller CT at step S20. For example, the CPU 18*a* reads out data on tone colors assigned to the pads, data on display on the display unit 15, and the like from the ROM 18*c*, and sets the read data as initial values. Furthermore, the CPU 18*a* sets the operating mode at the normal mode to set a mode flag MD indicative of the current operating mode at "0" which indicates that the current operating mode is the normal mode. In the normal mode in which player's performance will not be evaluated, a start flag ST indicative of whether the performance is being evaluated or not is set at "0" which indicates that the performance is not being evaluated. Then, the CPU 18*a* carries out a setting change program indicated in FIG. 5 at step S30. The setting change program is a subroutine of the main program, and is a program for changing various kinds of settings on the electronic percussion instrument set in accordance with player's operation of the setting operating elements 13. After starting the setting change process at step S30, the CPU 18*a* judges at step S31 whether the setting operating elements 13 have been operated or not. If the setting operating elements 13 have not been operated, the CPU 18*a* gives "no" to proceed to step S38 which will be described later. If the setting operating elements 13 have been operated, the CPU 18*a* gives "yes" to proceed to step S32. At step S32, the CPU 18*a* detects which operating element has been operated, and branches to a step corresponding to the detected operating element.

If the setting operating element detected at step S32 is a mode switch, the CPU 18*a* switches the operating mode at step S33. More specifically, the CPU 18*a* judges which mode is the current operating mode by use of the mode flag MD. In a case where the electronic percussion instrument set is in the normal mode, the CPU 18*a* switches the operating mode to the evaluation mode, and switches the mode flag MD to "1" to proceed to step S38. If the mode switch has been operated in a state where the electronic percussion instrument set is in the evaluation mode, the CPU 18*a* switches the operating mode to normal mode, and switches the mode flag MD to "0" to proceed to step S38.

If the setting operating element detected at step S32 is the start/stop switch, the CPU 18*a* judges at step S34 whether the current operating mode is evaluation mode or not. If the current operating mode is the normal mode, the CPU 18*a* proceeds to step S38. If the current operating mode is the evaluation mode, the CPU 18*a* starts or stops evaluation of performance at step S35. More specifically, if the start/stop switch has been operated during evaluation of performance, the CPU 18*a* stops evaluation. If the start/stop switch has been operated during a halt of evaluation, the CPU 18*a* starts evaluation, and proceeds to step S38. The judgment of whether performance is currently being evaluated or not is done by use of the start flag ST. When the CPU 18*a* starts evaluation, the CPU 18*a* sets the start flag ST at "1", and initializes parameters relating to evaluation of performance such as strike count DS indicative of the number of strikes on the pads counted from the start of evaluation and score SC indicative of evaluated result. For instance, the CPU 18*a* sets the strike count DS and the score SC at "0". When the evaluation is stopped, the CPU 18*a* sets the start flag ST at "0".

If the setting operating element detected at step S32 is the evaluation setting switch, the CPU 18*a* displays a menu for setting details about evaluation on the display unit 15 to further display setting items in accordance with player's selected menu at step S36. Then, the CPU 18*a* inputs player's operation, changes detailed settings on evaluation, and proceeds to step S38. For example, the manner in which the evaluation of performance starts can be changed. In an initial state, the evaluation of performance starts in response to player's operation of the start/stop switch as described above. However, the settings on the evaluation can be changed such that the evaluation will start when the player starts striking. Furthermore, evaluation time can be provided so that the evaluation will be automatically terminated when the evaluation time has elapsed since the start of the evaluation.

In a case where the setting operating element detected at step S32 is the other setting operating element, the CPU 18*a* changes the other setting at step S37. For instance, tone colors assigned to the pads can be changed. Then, the CPU 18*a* returns to the main process at step S38.

Figure 6:
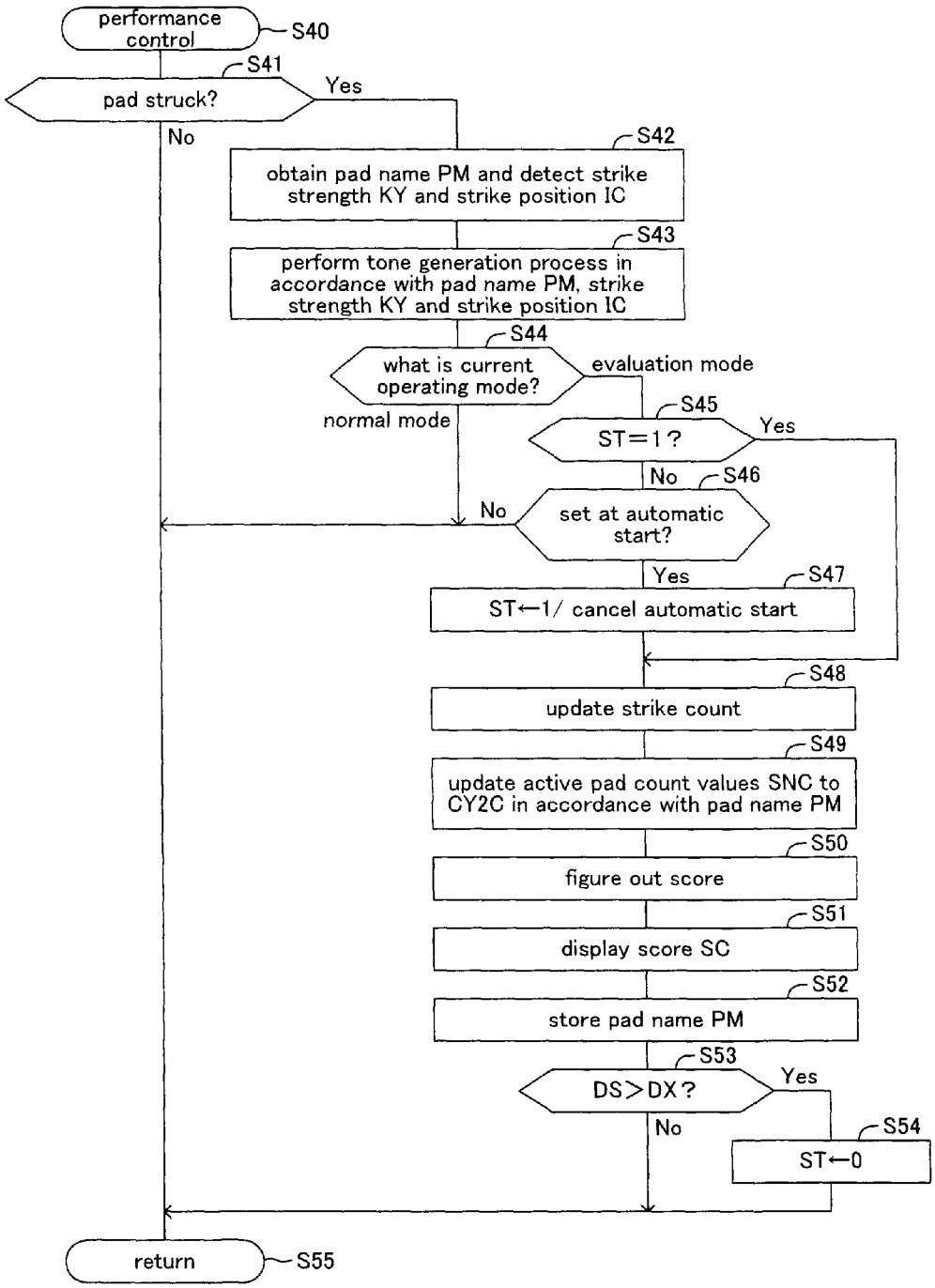
FIG. 6 is a flowchart of a performance control program.

The main process will be explained again. After the setting change process, the CPU 18*a* carries out a performance control program indicated in FIG. 6 at step S40. The performance control program is a subroutine of the main program, and is a program for generating musical tone signals corresponding to the pads which the player hit and evaluating the player's performance. After starting the performance control process at step S40, the CPU 18*a* detects at step S41 whether the pads have been struck by use of output values of the first sheet sensor SS1, the second sheet sensor SS2 and the piezo sensor PS of each pad. If any pads have not been struck, the CPU 18*a* gives "no" to proceed to step S55 which will be described later. If any of the pads has been struck, the CPU 18*a* gives "yes" to proceed to step S42. At step S42, the CPU 18*a* identifies the struck pad to obtain the pad name PM, to figure out the strike strength KY by use of the output signal output from the piezo sensor PS, and to figure out the strike position IC by use of the output signals output from the first sheet sensor SS1 and the second sheet sensor SS2.

Then, the CPU 18*a* carries out a tone generation process in accordance with the pad name PM, the strike strength KY and the strike position IC at step S43. In accordance with the pad name PM, the strike strength KY and the strike position IC, more specifically, the CPU 18*a* supplies parameters which define a musical tone signal which will be generated to the tone generator 16. By use of the supplied parameters, the tone generator 16 generates the musical tone signal, and supplies the generated musical tone signal to the sound system 17.

Then, the CPU 18*a* judges at step S44 whether the current operating mode is the evaluation mode or not. If the current operating mode is the normal mode, the CPU 18*a* proceeds to step S55 which will be described later. If the current operating mode is the evaluation mode, the CPU 18*a* judges at step S45 whether the evaluation of performance is currently being conducted or not. If the evaluation of performance is not being conducted (ST="0"), the CPU 18*a* gives "no" to judge at step S46 whether the electronic percussion instrument set is set at the automatic start (see step S36 of FIG. 5). If the electronic percussion instrument set is not set at the automatic start, the CPU 18*a* gives "no" to proceed to step S48. If the electronic percussion instrument set is set at the automatic start, the CPU 18*a* gives "yes" to start the evaluation at step S47 to set the start flag ST at "1" to initialize the parameters relating to the evaluation of performance such as the strike count DS and the score SC to proceed to step S48. For instance, the strike count DS and the score SC are initialized to "0". In addition, the CPU 18*a* cancels the automatic start. The automatic start is canceled in order to prevent restart of evaluation caused by a player's strike made after the completion of the evaluation.

In a case where it is judged at step S45 that the evaluation of performance is being conducted (ST=1), the CPU 18*a* proceeds to step S48. At step S48, the CPU 18*a* increments the strike count DS. Then, the CPU 18*a* updates active pad count values SNC, TM1C, TM2C, TM3C, BSC, HHC, CY1C, and CY2C (hereafter denoted as active pad count values SNC to CY2C) at step S49. The active pad count values SNC to CY2C are count values provided to correspond to the pads SN to CY2, respectively, and indicate the number of strikes which have been made, after a strike on one of the pads, on the other pads. The largest value of the count value is "5". As indicated in FIG. 7, the active pad count values SNC to CY2C are set at "5" by parameter initialization at step S47. When any one of the pads is struck, the CPU 18*a* sets the active pad count value corresponding to the pad name PM of the struck pad at "0", and increments the active pad count values of the other pads. In a case where the active pad count value has been "5" before the increment, however, the CPU 18*a* will not increment the active pad count value.

Hereafter, transitions of the active pad count values will be described concretely, referring to FIG. 7. In a case, for example, where the pad SN was hit after the initialization, the CPU 18*a* sets the active pad count value SNC at "0" at step S49. In this case, because the other active pad count values are "5", the CPU 18*a* will not increment the other active pad count values. Although the CPU 18*a* repeatedly carries out the performance control process as described later, if the pad TM1 is struck (in other words, if the pad name PM is "TM1") at the process repeated next, the CPU 18*a* sets the active pad count value TM1C at "0" and increments the active pad count value SNC at step S49 of the next performance control process. As a result, the active pad count value SNC is set at "1". The other active pad count values remain at "5". In a case where a pad is struck before the active pad count value of the pad is incremented to become "5", the active pad count value of the pad is set at "0". In a case where a pad is struck in succession, the active pad count value of the pad remains "0".

The performance control process will be explained again. At step S50, the CPU 18*a* figures out the score SC. More specifically, by use of the strike strength KY, and a pad type coefficient TY, an active pad state APS and a move distance coefficient ID which will be explained next, the CPU 18*a* carries out a calculation of "strike strength KY×pad type coefficient TY+strike strength KY×active pad state APS× move distance coefficient ID" to add the calculated result to the score SC obtained at the previous execution of step S50 to obtain the current score SC. The above-described pad type coefficient TY is a coefficient previously provided for each pad as indicated in FIG. 8, and is stored as a pad type coefficient table in the ROM 18*c*. Respective values of the pad type coefficients TY are provided to correspond to respective shapes of the pads. The CPU 18*a* refers to the pad type coefficient table to determine the pad type coefficient TY corresponding to a struck pad at the execution of step S50. The above-described move distance coefficient ID is a coefficient previously provided in accordance with the distance between the previously struck pad and the currently struck pad as indicated in FIG. 9, and is stored as a move distance coefficient table in the ROM 18*c*. More specifically, the greater the distance between the previously struck pad and the currently struck pad is, the greater the move distance coefficient ID will be. However, the move distance coefficient ID of a case where the previously or currently struck pad is the first cymbal CY1 or the second cymbal CY2 is "3". The CPU 18*a* refers to the move distance coefficient table by use of the pad name ZPM of the previously struck pad and the pad name PM of the currently struck pad to determine the move distance coefficient ID at the execution of step S50. In a case where the active pad count value of the currently struck pad was "5" just before the active pad count value of the currently struck pad is changed "0", the CPU 18*a* sets the active pad state APS at "1". In a case where the active pad count value of the currently struck pad was any of "0" to "4" just before the active pad count value of the currently struck pad is changed to "0", the CPU 18*a* sets the active pad state APS at "0". Therefore, until a strike on one of the pads is followed by 5 strikes on the other pads, the distance between the pads will not affect the score SC.

At step S51, the CPU 18*a* displays the score SC on the display unit 15. At step S52, the CPU 18*a* stores the pad name PM of the currently struck pad as the pad name ZPM indicative of the previously struck pad. At step S53, the CPU 18*a* judges whether the strike count DS has exceeded a predetermined strike count DX (e.g., 100 strikes). If the strike count DS has not exceeded the strike count DX yet, the CPU 18*a* gives "no" to proceed to step S55. If the strike count DS has exceeded the strike count DX, the CPU 18*a* gives "yes" to proceed to step S54 to set the start flag ST at "0" to terminate the evaluation of the performance to return to the main process at step S55. Then, the CPU 18*a* repeats the process formed of the setting change process and the performance control process.

The electronic percussion instrument set configured as described above is able to evaluate liveliness of player's performance in the evaluation mode. The greater the distance between consecutively struck two pads is, the greater the player's body movement is, resulting in lively performance. Therefore, the electronic percussion instrument set is designed such that the greater the distance between the consequently struck two pads is, the greater the move distance coefficient ID will be, while the move distance coefficient ID will be multiplied by the strike strength KY. Resultantly, the movement of the player's body can be taken into consideration for evaluation of performance. In a case, however, where only two of the pads are struck alternately by the player with right and left sticks, brushes or the like, the player's body movements will not be dynamic that much to fail to produce lively performance. Therefore, the electronic percussion instrument set is designed such that a result obtained by multiplying the strike strength KY by the move distance coefficient ID will be further multiplied by the active pad state APS so that the distance between the successively struck pads will not affect the score until a strike on one of the pads is followed by 5 strikes on the other pads. Furthermore, the degree of difficulty in roll performance by which one of the pads is consecutively hit varies from pad to pad. As described above, therefore, the electronic percussion instrument set is designed such that the score SC will be figured out by multiplying the pad type coefficient TY predetermined for each pad by the strike strength KY so that the difficulty in performance will affect the score SC.

Furthermore, it should be understood that the invention is not limited to the above-described embodiment, and can be variously modified without departing from the object of the invention.

For instance, the calculation of the score SC is not limited to the above-described expression but may be done by a different expression. For example, a change in the strike position IC on a pad may be taken into consideration in figuring out the score. More specifically, the score may be figured out such that when one of the pads is hit consecutively, a previous strike position ZIC will be compared with the current strike position IC so that predetermined points will be added if the comparison reveals that the two strike positions are different with each other. More specifically, a strike on the circumference portion of the head portion 11 is given "1" as a position coefficient, while a strike on a halfway portion of the head portion 11 is given "2" as a position coefficient. Furthermore, a strike on the center portion of the head portion 11 is given "3" as a position coefficient. At step S51, furthermore, the CPU 18*a* adds an absolute value obtained by figuring out the difference between the position coefficient of the previous strike position ZIC and the position coefficient of the current strike position IC to the expression result obtained by the expression of the embodiment. At step S52, in this case, the current pad name PM is stored as the previous pad name ZPM, while the current strike position IC is stored as the previous strike position ZIC.

Furthermore, a change in the strike strength KY may be taken into consideration in figuring out the score SC. More specifically, a previous strike strength ZKY may be compared with the current strike strength KY so that predetermined points corresponding to the difference between the strike strengths will be added. At step S51, more specifically, the CPU 18*a* adds an absolute value obtained by figuring out the difference between the previous strike strength ZKY and the current strike strength KY (or points corresponding to the absolute value) to the expression result obtained by the expression of the embodiment. At step S52, in this modification, the current pad name PM is stored as the previous pad name ZPM, while the current strike strength KY is stored as the previous strike strength ZKY.

Furthermore, striking speed may be taken into consideration in figuring out the score SC. By using the timer 18*b*, more specifically, the CPU 18*a* measures the time taken from the previous strike to the current strike to add predetermined points (e.g., the inverse of the measured time) to the expression result obtained by the expression of the embodiment if the measured time is shorter than a predetermined short standard time (e.g., 0.2 second).

Without multiplying the coefficients such as explained in the above-described embodiment, furthermore, points corresponding to the strike strength, a change in the strike strength, a change in the strike position and the striking speed may be simply added. In this case, similarly to the above-described embodiment, the score SC displayed on the display unit 15 may be an accumulated value accumulated from the start of the evaluation of a performance or an instant value indicating the score of each strike. Alternatively, both the accumulated value and the instant value may be displayed.

Furthermore, points (hereafter referred to as area points) given in accordance with the number of pad types struck within a predetermined short period of time (e.g., 1 second) may be added to the score SC. In this case, points may be added only when the pads are struck with a stick or a brush. More specifically, the CPU 18*a* initializes the timer 18*b* at step S20. More specifically, the timer 18*b* is set such that an interrupt signal will be transmitted to the CPU 18*a* every second. Furthermore, the CPU 18*a* secures, in the RAM 18*d*, a storage area for storing pad flags which are provided for respective pads except the pad BS and each of which indicates whether a corresponding pad has been struck within the predetermined period of time, and sets the value of each of the pad flags at "0" which indicates that the corresponding pad has not been struck. At step S47, the CPU 18*a* starts evaluation of performance, and makes the timer 18*b* start measuring time. If any pad other than the pad BS is struck with the strike strength KY being a predetermined strength (e.g., 80% of the maximum strength) or more, the CPU 18*a* sets, at step S50, the value of the pad flag corresponding to the struck pad at "1" indicating that the pad has been struck. However, in a case where the pad HH is struck by user's depression of the pedal provided on the stand of the pad HH, the CPU 18*a* will not change the value of the pad flag corresponding to the pad HH. Until reception of an interrupt signal from the timer 18*b*, the CPU 18*a* sets the value of the pad flag corresponding to a struck pad at "1" at each execution of step S50.

When the CPU 18*a* receives an interrupt signal from the timer 18*b*, the CPU 18*a* combines the values of the respective pad flags. Then, the CPU 18*a* subtracts a predetermined number of pad types (e.g., "2") from the combined value of the pad flags. Then, the CPU 18*a* adds a value obtained by multiplying the subtracted result by a predetermined active area point coefficient (e.g., "400") as area points to the score SC. Then, the CPU 18*a* sets the value of each pad flag at "0" and returns to the step where the interrupt signal was received. The number of pad types which will be subtracted from the combined value of the pad flags is a parameter which specifies the lowest value of the number of pad types which should be struck within the predetermined short period of time. In other words, the greater the predetermined number of pad types is, the greater the number of pad types demanded to be struck by the player within the predetermined short period of time in order to gain higher area points will be. Furthermore, the active area point coefficient is a coefficient which specifies the ratio of the area points to the score SC. According to this modification, after the start of evaluation of performance, area points will be calculated every second, for example. Then, area points will be added only in a case where at least three types of pads, for example, excluding the pad BS are struck with a stick, brush or the like in one second with each strike strength of 80% or more of the maximum strength.

In the above-described example, the CPU 18*a* calculates area points and adds the calculated area points to the score SC each time an interrupt signal is received from the timer 18*b*. Instead of this scheme, however, each time an interrupt signal is received from the timer 18*b*, the CPU 18*a* may store the combined value of respective values of all the pad flags in the RAM 18*d*, and then sets each pad flag at "0" to return to the step where the interrupt signal was received. In this case, the CPU 18*a* calculates a mean value of the combined values stored in the RAM 18*d* when the CPU 18*a* terminates the evaluation of performance (step S54). Then, the CPU 18*a* subtracts the predetermined number of pad types from the calculated mean value. Then the CPU 18*a* adds a value obtained by multiplying the subtracted result by the predetermined active area point coefficient as area points to the score SC, and displays the resultant score SC on the display unit 15.

In the above-described embodiment, furthermore, the evaluation of a performance is terminated when the strike count exceeds a predetermined strike count DX (step S53 and step S54). However, the embodiment may be modified such that by using the timer 18*b*, the CPU 18*a* measures the time from the start of the evaluation of a performance so that the evaluation of the performance will be terminated when the measured time passes a predetermined period of time (e.g., 10 seconds).

In the above-described embodiment, furthermore, each pad corresponds to a different percussion instrument. However, the surface of a pad may be divided into sections so that a strike on each section can be detected. In this modification, each section will be assigned a different percussion instrument.

In the above-described embodiment, furthermore, the pad type coefficient TY is defined according to the shape of pad. However, the pad type coefficient TY may be defined according to the tone colors assigned to the pads. For instance, the pad type coefficient TY may be designed such that the more high frequency components the tone color of a percussion instrument assigned to a pad has, the greater the value of the pad type coefficient TY of the pad will be. An electronic percussion instrument set of such a modification can judge that strike tones having more high-frequency components are more lively to give a higher score.

In the above-described embodiment, furthermore, the CPU 18*a* of the electronic percussion instrument set calculates the score SC and displays the score SC on the display unit 15. Instead of this scheme, however, a musical performance evaluating apparatus (e.g., a personal digital assistant having a display unit) which evaluates performance of an electronic percussion instrument set may be connected to the controller CT through the external interface circuit which is not shown so that the musical performance evaluating apparatus can calculate the score SC and display the score SC. In this case, in response to a strike on a pad, the CPU 18*a* carries out the tone generation process in accordance with the pad name PM, the strike strength KY and the strike position IC, and transmits the pad name PM, the strike strength KY, the strike position IC, the mode flag MD and the start flag ST to the musical performance evaluating apparatus at step S43. Then, the CPU 18*a* proceeds to step S55 without executing steps S44 to S54. Every time the musical performance evaluating apparatus receives the pad name PM, the strike strength KY, the strike position IC, the mode flag MD and the start flag ST from the CPU 18*a*, the musical performance evaluating apparatus carries out a program formed of steps similar to steps S44 to S54 to calculate the score SC to display the calculated score SC.

What is claimed is:

1. An electronic percussion instrument set comprising:

a plurality of strike portions each assigned a tone color of a different musical instrument and configured to be struck by a player;

an identifying section identifying the strike portion included in the plurality of the strike portion and struck by the player;

a tone generating section that generates a musical tone of the musical instrument assigned to the identified strike portion;

a scoring section that awards a score in accordance with a performance;

a displaying section that displays the awarded score;

a strike strength detecting section that detects a strength of the strike on the identified strike portion, wherein the scoring section awards an amount of points when a first strike portion and a second strike portion, among the plurality of strike portions, different with each other, are struck in a sequence, and wherein the scoring section further awards an amount of points corresponding to the strength of the strike.

2. The electronic percussion instrument set according to claim 1, wherein the scoring section awards an amount of points in accordance with the striking sequence of the first strike portion and the second strike portion.

3. The electronic percussion instrument set according to claim 1, wherein the greater a distance between the first and second strike portions is, the scoring section awards the higher the amount of points.

4. The electronic percussion instrument set according to claim 1, wherein in a case where the first strike portion is struck before the second strike portion is struck, the scoring section awards the amount of points only if a previous strike on the second strike portion is followed by a predetermined number of strikes or greater on the strike portions other than the second strike portion.

5. The electronic percussion instrument set according to claim 1, wherein the scoring section further awards an amount of points corresponding to a time interval between the strikes on the first and second strike portions.

6. The electronic percussion instrument set according to claim 1, wherein the scoring section further awards an amount of points corresponding to a shape of the identified strike portion.

7. The electronic percussion instrument set according to claim 1, wherein the scoring section further awards an amount of points in accordance with the number of strike portions struck within a predetermined period of time.

8. The electronic percussion instrument set according to claim 1, wherein the plurality of strike portions imitate shapes of percussion instruments.

9. The electronic percussion instrument set according to claim 1, wherein the plurality of strike portions comprise a pad surface divided into a plurality of sections.

10. A non-transitory computer-readable medium storing a computer program executable by a processor of an electronic percussion instrument set having a plurality of strike portions assigned a tone color of a different musical instrument and configured to be struck by a player, a tone generator that generates musical tones of the musical instruments assigned to the strike portions, and a display unit, to execute a method comprising:

an identifying step of identifying the strike portion included in the plurality of the strike portion and struck by the player;

a tone generating step of generating a musical tone of the musical instrument assigned to the identified strike portion;

a scoring step of awarding a score in accordance with a performance, a displaying step of displaying the awarded score; and a strike strength detecting step of detecting a strength of the strike on the identified strike portion, wherein the scoring step awards an amount of points when a first strike portion and a second strike portion, among the plurality of strike portions, different with each other, are struck in a sequence, and wherein the scoring step further awards an amount of points corresponding to the strength of the strike.

11. An electronic percussion instrument set comprising:

a plurality of strike portions each assigned a tone color of a different musical instrument and configured to be struck by a player;

an identifying section identifying the strike portion included in the plurality of the strike portion and struck by the player;

a tone generating section that generates a musical tone of the musical instrument assigned to the identified strike portion;

a scoring section that awards a score in accordance with a performance; and a displaying section that displays the awarded score, wherein the scoring section awards an amount of points when a first strike portion and a second strike portion, among the plurality of strike portions, different with each other, are struck in a sequence, and wherein the greater a distance between the first and second strike portions is, the scoring section awards the higher the amount of points.

12. An electronic percussion instrument set comprising:

a plurality of strike portions each assigned a tone color of a different musical instrument and configured to be struck by a player;

an identifying section identifying the strike portion included in the plurality of the strike portion and struck by the player;

a tone generating section that generates a musical tone of the musical instrument assigned to the identified strike portion;

a scoring section that awards a score in accordance with a performance; and a displaying section that displays the awarded score, wherein the scoring section awards an amount of points when a first strike portion and a second strike portion, among the plurality of strike portions, different with each other, are struck in a sequence, and wherein the scoring section further awards an amount of points corresponding to a shape of the identified strike portion.

* * * * *